US006612230B1

(12) United States Patent
McAdoo et al.

(10) Patent No.: US 6,612,230 B1
(45) Date of Patent: Sep. 2, 2003

(54) TRUSS ASSEMBLY AND SPLICING METHOD AND APPARATUS

(75) Inventors: David L. McAdoo, Alvarado, TX (US); Timothy K McAdoo, Cedar Hill, TX (US)

(73) Assignee: Alpine Engineered Products, Inc.

( * ) Notice: Subject to any disclaimer, the term of this patent is extended or adjusted under 35 U.S.C. 154(b) by 98 days.

(21) Appl. No.: 09/685,921

(22) Filed: Oct. 10, 2000

(51) Int. Cl.[7] ..... B30B 3/02; B30B 13/00

(52) U.S. Cl. ..... 100/210; 100/35; 100/DIG. 13; 100/100; 100/209

(58) Field of Search ..... 100/35, 913, 160, 100/161, 155, 168, DIG. 13, 100, 210, 176; 269/296, 303, 910

(56) References Cited

U.S. PATENT DOCUMENTS

| | | | | | |
|---|---|---|---|---|---|
| 3,538,843 | A | * | 11/1970 | Lubin | 100/53 |
| 3,855,917 | A | * | 12/1974 | Farrell et al. | 100/35 |
| 3,939,764 | A | | 2/1976 | McCormack | 100/100 |
| 4,005,520 | A | | 2/1977 | Sanford | 29/432 |
| 4,084,498 | A | | 4/1978 | Weaver | |
| 4,089,107 | A | | 5/1978 | Sanford | 29/798 |
| 4,154,164 | A | | 5/1979 | Hammond | 100/153 |
| 4,339,117 | A | * | 7/1982 | Tison | 269/289 MR |
| 4,341,153 | A | | 7/1982 | Bowser | 100/35 |
| 4,627,564 | A | | 12/1986 | Bowser | 227/152 |
| 5,111,861 | A | | 5/1992 | Gore et al. | 144/256.1 |
| 5,207,046 | A | | 5/1993 | Vekkeli | 52/730.7 |
| 5,211,108 | A | | 5/1993 | Gore et al. | |
| 5,547,002 | A | | 8/1996 | Runnebaum | 144/332 |
| 5,582,099 | A | | 12/1996 | Rosser | 100/35 |
| 6,100,810 | A | * | 8/2000 | Koorsen | 29/721 |

* cited by examiner

*Primary Examiner*—Allen Ostrager
*Assistant Examiner*—Jimmy Nguyen

(74) *Attorney, Agent, or Firm*—Crutsinger & Booth

(57) ABSTRACT

In accordance with the principles and concepts of the invention, apparatus and methods for assembling pre-cut members into trusses and joists and splicing pre-cut members into truss chords are presented. According to the invention, a splicing apparatus for connecting chord members end-to-end comprises a table having a table surface for supporting abutting chord members, a gantry press mounted adjacent to the table surface and configured to move relative to the table surface, the gantry press having at least two press rollers, each press roller having a peripheral surface positioned a successively closer clearance distance to the table surface. The splicing apparatus may further comprise at least two abutting chord members supported on the table surface, the chord members forming end-joints at each abutment and at least one connector plate positioned above each end-joint whereby each of the press rollers presses the connector plates at least partially into the chord members as the gantry press moves relative to the table surface. The apparatus may further comprise at least one connector plate positioned below each end-joint. The press rollers may be adjustable whereby the clearance distances of the peripheral surfaces of the press rollers above the table surface can be adjusted. The splicing apparatus may also comprise a truss assembly table.

The chord members are spliced together, end-to-end, by placing multiple wooden chord members in end-to-end abutment on the table surface, the chord members having end-joints at each end-to-end abutment, placing at least one connector plate over each end-joint, and pressing the connector plates into the chord members with a gantry press supported above the table surface and configured for movement relative to the table surface. The gantry press has a plurality of press rollers, each press roller having a peripheral surface positioned successively closer to the table surface, each press roller incrementally pressing the at least one connector plate into the chord members. The method may further comprise placing at least one connector plate under each end-joint between chord members. The clearance distances of the press roller peripheral surfaces may be adjusted.

62 Claims, 14 Drawing Sheets

TRUSS ASSEMBLY AND SPLICING METHOD AND APPARATUS

TECHNICAL FIELD

The present invention relates in general to an apparatus and method for fabricating structural components. More particularly, this invention concerns an apparatus and method for assembling pre-cut members into trusses and joists and splicing pre-cut members into truss chords.

BACKGROUND OF INVENTION

Prefabricated trusses for use as roof or floor supports are assembled from pre-cut wooden chord and web members positioned in abutting relationship and connected together using toothed fastener plates. Where the length of the desired truss exceeds the length of readily available wood members, it is necessary to splice, or connect, multiple members in end-to-end abutment to create a single expanse of wooden chord.

Separate truss assembly and splicing devices have been developed for performing these tasks semi-automatically. In a truss assembly device, the pre-cut wooden members are positioned manually over a rigid support surface, then jigged or clamped in place. Connector plates then are laid over the abutting joints of the wooden members. The connector plates are then embedded into the members with a gantry or other roller press to secure the joints on one side. The gantry press typically has a single roller which passes over the truss assembly, thereby squeezing the truss assembly between the table surface and the roller. The semi-complete truss is then turned over and similarly secured at the joints on the opposite side with another set of connector plates. The gantry roller and truss table are shown in detail in U.S. Pat. Nos. 5,211,108 and 4,084,498 and in co-pending application Ser. No. 09/416,862, filed Oct. 13, 1999 by David McAdoo and Michael Rosser, the disclosure of which is incorporated herein by reference for all purposes.

In a typical splicing device, two wooden members are joined together in end-to-end abutment. Splicing of wooden members using a gantry press table having a single roller passing over a rigid table surface has been unsatisfactory, resulting in bowed, bent or cambered spliced chords, as shown in FIGS. 1 and 2. Chord members 2, spliced together at end-joint 8 on table surface 4 by gantry roller 9, are held together by connector plates 6. After the plates 6 are pressed into the chords 2, the spliced chords exhibit an undesirable bow, as seen in FIG. 2.

Typically, splicing and truss assembly operations occur on separate machines. Chord members are spliced together in one location within a facility, then laboriously moved to a truss assembly device where they are incorporated into a truss assembly. This process requires time, space and labor.

There exists a need for a new and improved truss assembly and splicing apparatus.

SUMMARY OF THE INVENTION

In accordance with the principles and concepts of the invention, apparatus and methods for assembling pre-cut members into trusses and joists and splicing pre-cut members into truss chords are presented. According to the invention, a splicing apparatus for connecting chord members end-to-end comprises a table having a table surface for supporting abutting chord members, a gantry press mounted adjacent to the table surface and configured to move relative to the table surface, the gantry press having at least two press rollers, each press roller having a peripheral surface positioned a successively closer clearance distance to the table surface. The splicing apparatus may further comprise at least two abutting chord members supported on the table surface, the chord members forming end-joints at each abutment and at least one connector plate positioned above each end-joint whereby each of the press rollers presses the connector plates at least partially into the chord members as the gantry press moves relative to the table surface. The apparatus may further comprise at least one connector plate positioned below each end-joint. The press rollers may be adjustable whereby the clearance distances of the peripheral surfaces of the press rollers above the table surface can be adjusted. The splicing apparatus may also comprise a truss assembly table.

The chord members are spliced together, end-to-end, by placing multiple wooden chord members in end-to-end abutment on the table surface, the chord members having end-joints at each end-to-end abutment, placing at least one connector plate over each end-joint, and pressing the connector plates into the chord members with a gantry press supported above the table surface and configured for movement relative to the table surface. The gantry press has a plurality of press rollers, each press roller having a peripheral surface positioned successively closer to the table surface, each press roller incrementally pressing the at least one connector plate into the chord members. The method may further comprise placing at least one connector plate under each end-joint between chord members. The clearance distances of the press roller peripheral surfaces may be adjusted.

Further according to the invention is presented a truss assembly and chord splicing apparatus combination having a table with a truss assembly surface for supporting a truss assembly, a splicing surface for supporting abutting chord members and a gantry press assembly mounted adjacent to the table and configured to move relative to the table, the gantry press assembly having a primary press roller configured to move over the truss assembly surface and at least two splicing press rollers configured to move over the splicing surface, the at least two splicing press rollers each having a peripheral surface positioned successively closer clearance distances above the splicing surface. The truss assembly may also have a plurality of abutting truss members positioned on the truss assembly surface forming truss joints at each abutment and abutting chord members supported on the splicing surface, the chord members forming end-joints at each abutment. A connector plate is positioned above each joint. Connector plates may be positioned under the chord joints. The primary press roller may further be configured to move over the splicing surface. The truss assembly surface and the splicing surface may be different heights above a floor surface.

Further is presented a truss assembly and chord splicing apparatus comprising a truss assembly table having a truss assembly surface and a splicing surface with a gantry press having a primary press roller and a splicing subassembly, the subassembly comprising at least two splicing press rollers, the splicing press rollers each having a peripheral surface positioned a successively closer clearance distance above the splicing surface.

BRIEF DESCRIPTION OF THE DRAWINGS

Drawings of a preferred embodiment of the invention are annexed hereto, so that the invention may be better and more fully understood, in which.

Figure 1:
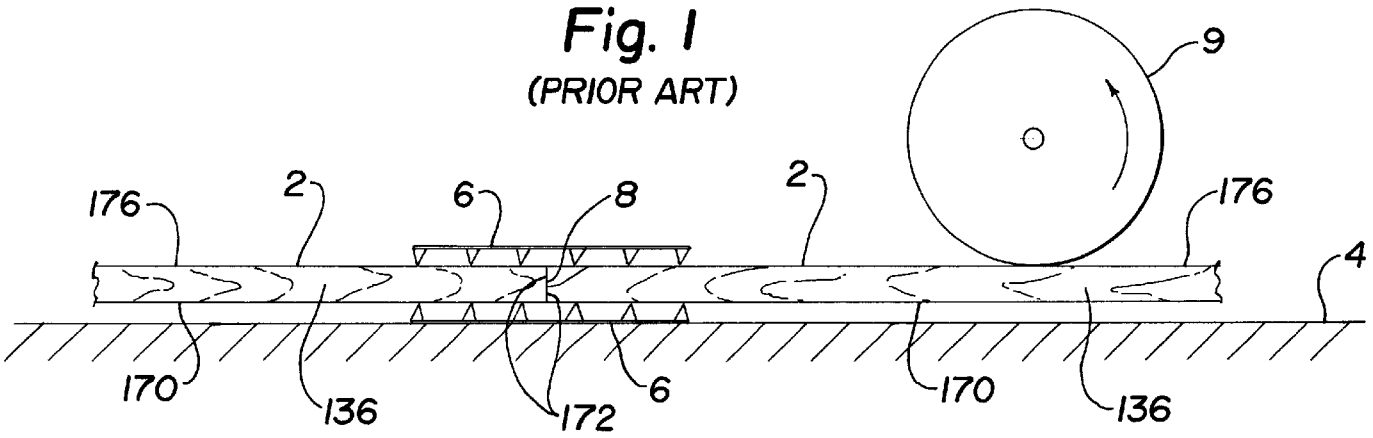
Fig. 1 (PRIOR ART)
FIG. 1 is an elevational schematic view of a typical prior art splicing apparatus.

Numeral references are employed to designate like parts throughout the various figures of the drawing. Terms such as Aleft, @ Aright, @ Aclockwise, @ Acounter-clockwise, @ Ahorizontal, @ Avertical, @ Aup@ and Adown@ when used in reference to the drawings, generally refer to orientation of the parts in the illustrated embodiment and not necessarily during use. The terms used herein are meant only to refer to relative positions and/or orientations, for convenience, and are not to be understood to be in any manner otherwise limiting. Further, dimensions specified herein are intended to provide examples and should not be considered limiting.

DESCRIPTION OF A PREFERRED EMBODIMENT

The invention is herein described with reference to the accompanying drawings and is not intended to limit the scope of the claimed invention, but is intended to describe particular embodiments to disclose the best mode of the invention to those skilled in the art.

Figure 3:
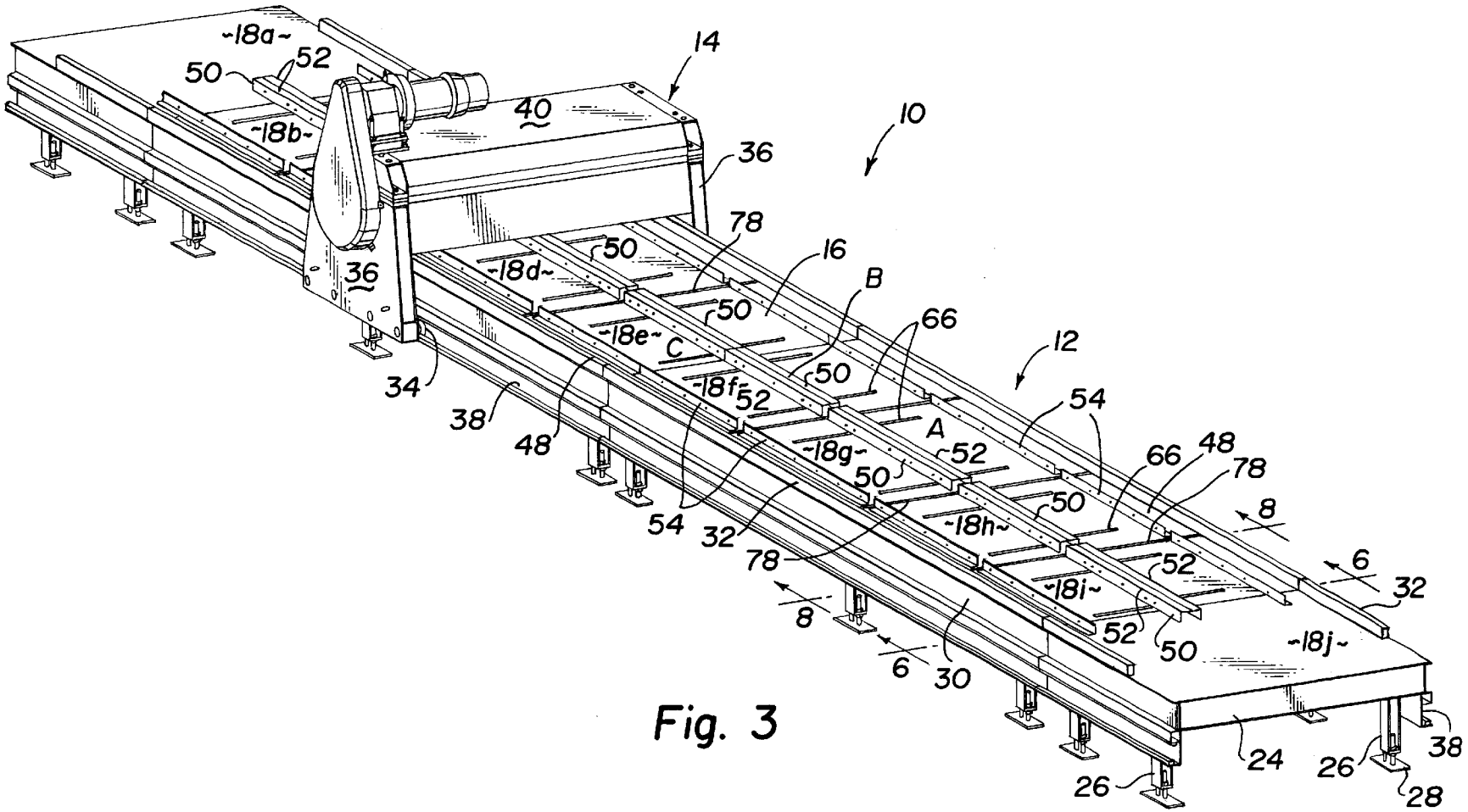
FIG. 3 is a perspective view of a truss assembly apparatus of the invention shown without attached splicer subassembly for clarity.
Figure 4:
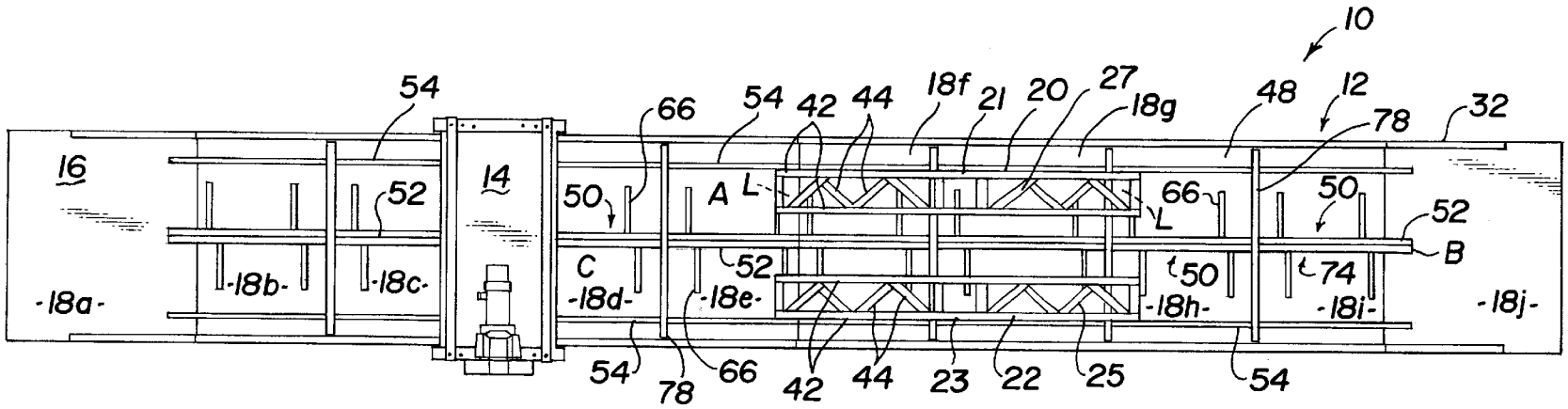
FIG. 4 is a top plan view of a truss assembly apparatus of the invention shown without attached splicer subassembly for clarity.
Figure 5:
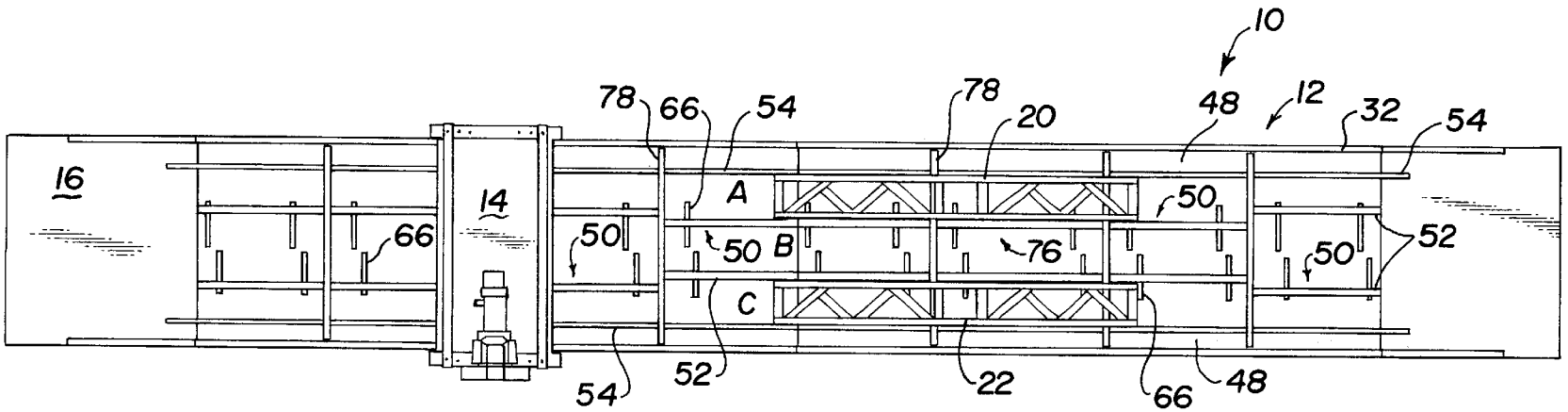
FIG. 5 is a top plan view of a truss assembly apparatus of the invention with clamping assemblies actuated.

Truss Assembly Apparatus:

FIGS. 3–5 show a truss assembly apparatus 10 for semi-automatic manufacture of prefabricated structural components, particularly wooden trusses and joists. The truss assembly apparatus 10 comprises a truss table 12 and a table gantry press 14 supported on the table for movement therealong.

The work surface 16 of the truss table 12 is defined by table plates 18*a*–*j*, which are arranged end-to-end. Table plates 18*b*–*i* provide working space for assembly of the trusses 20 and 22, while plates 18*a* and 18*j* provide staging areas for the table gantry press 14. The table may be designed to any desired length. The plates 18 are supported by a plurality of cross-members 24 which are mounted to the legs 26 of the table. Each leg 26 of the table 12 preferably includes a foot 28 threadedly attached thereto for height adjustment and leveling of the truss table 12 (best seen in FIG. 3). Side beams 30 extend longitudinally beneath the table plates 18. Outer rails 32 extend longitudinally above the table work surface 16 along the outer edges of the table plates 18. Clamping assemblies 50 are attached to the table 12, as shown.

The table gantry press 14 straddles the work surface 16 of the truss table 12 and is supported to run along the length of the table. Gantry wheels 34, located in the gantry arms 36, roll along the gantry tracks 38, which are mounted to the truss table 12. A primary roller press 140 (shown in FIG. 13) located in the gantry body 40 presses downwardly on the truss table 12 as the gantry press 14 passes along the table length.

Figure 6:
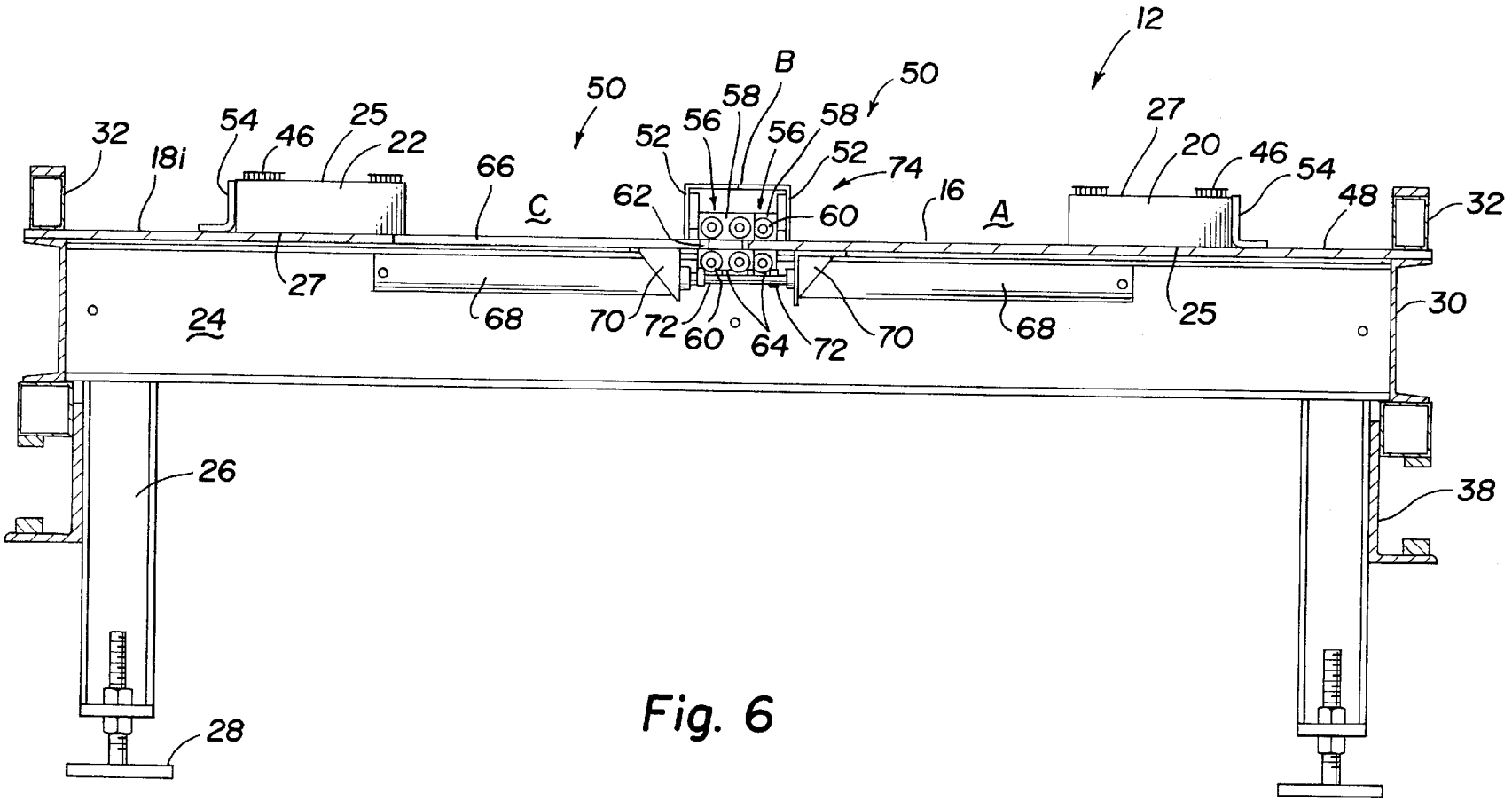
FIG. 6 is an elevational sectional view of a truss table of the invention with clamping assemblies taken along line 6—6 of FIG. 3.
Figure 7:
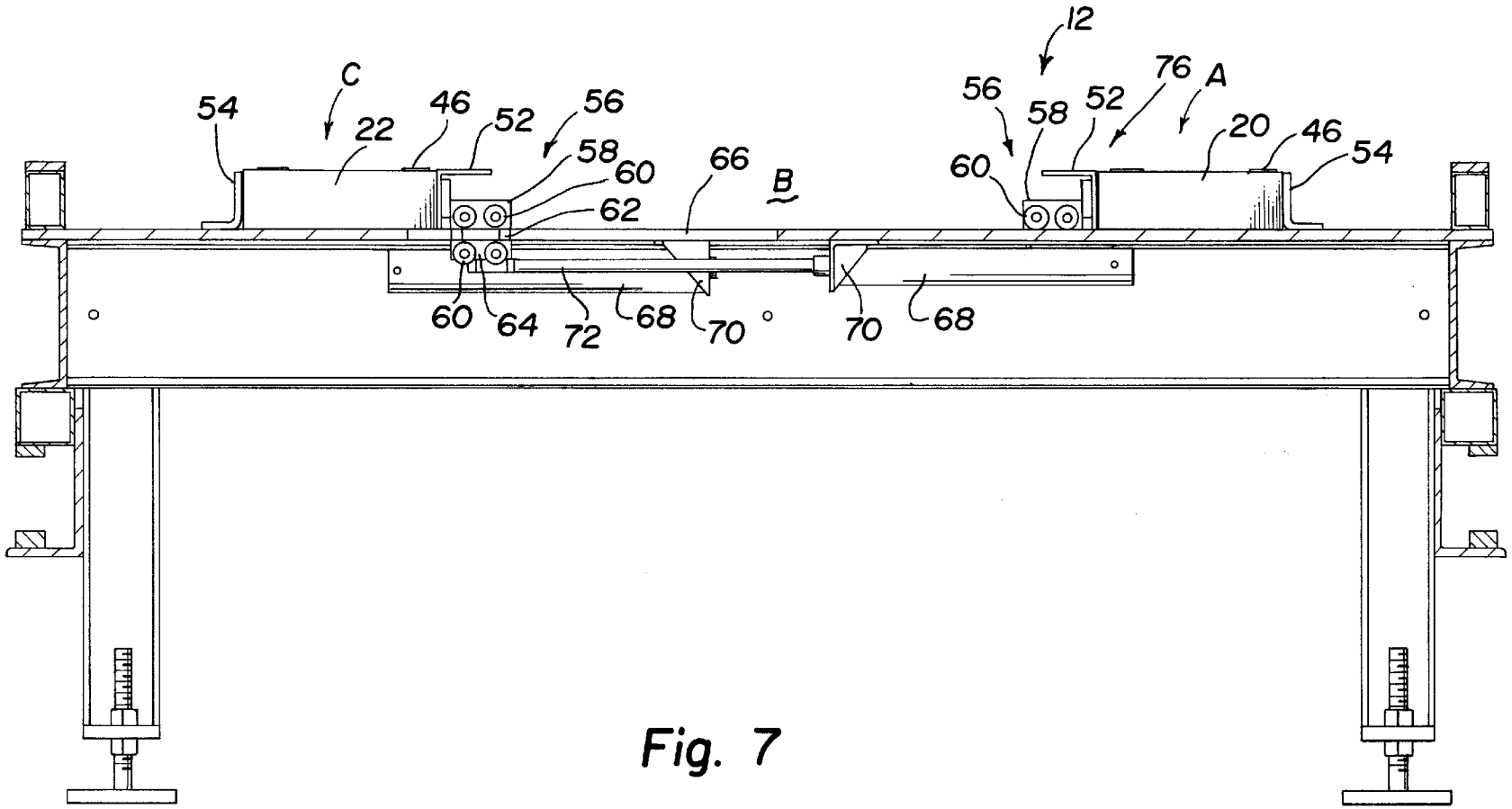
FIG. 7 is an elevational sectional view of a truss table of the invention with trusses clamped by the clamping assemblies.

Referring to FIGS. 4 and 5, truss table 12 is divided into three longitudinal zones A, B, and C by the clamping assemblies 50. In the preferred embodiment, two clamping assemblies 50 are mounted on each of the support plates 18. Assembly zones A and C on each plate 18 are coincident with the inner and outer jigs 52 and 54 of the clamping assemblies 50. Intermediate zone B extends between the clamping assemblies 50 and may be reduced to zero area when the clamping assemblies 50 are not actuated to clamp a truss, such as trusses 20 and 22, as seen in FIG. 4 and as will hereinafter be described. During operation of the truss assembly apparatus 10, precut truss chords 42 and webs 44 are manually placed in a first truss position 21 with a first truss face 25 contacting the table surface in zone A and are secured in place by the clamping assembly 50. Toothed connector plates 46, which may be stored in the recessed areas 48 between the outer rails 32 and the outer longitudinal jigs 52, are then placed over the joints between the truss members 42 and 44 (as seen in FIGS. 6 and 7) and subsequently embedded in place by passage of the gantry press 14 over the truss 20. The semi-finished truss 20 is then unclamped, rotated along its longitudinal axis L, and placed in zone C so that the embedded connector plates 46 are positioned downwardly. The semi-finished truss 20, now in the second truss position 23, the location of truss 22 in FIG. 4, with a second truss face 27 contacting the table surface is clamped in place by the clamping assembly 50 and secured at the joints on the now upwardly facing side of the truss 22 with connector plates 46 embedded therein by another passage of the gantry press 14. The now completed truss 22 is unclamped, removed from zone C, and moved off of the truss table 12 for storage. During typical use of the truss assembly apparatus 10, connector plates 46 are pressed into trusses 20 and 22 in both zones A and C during a single passage of the gantry press 14.

Two clamping assemblies 50 are mounted on each plate 18, as shown in FIGS. 3 and 4. The details of the clamping assemblies 50 are best illustrated in FIGS. 6 and 7. Each clamping assembly 50 includes an inner longitudinal jig 52 and an outer longitudinal camber inducing rail or jig 54 each of which may be divided into a plurality of longitudinally spaced jigs, as shown. The jigs 52 and 54 maybe of angle irons oriented as shown. The outer jigs 54 are attached to the working surface 16 of the truss table 12. Preferably the outer jigs are bolted, or otherwise removably attached, to allow reconfiguration of the jigs as desired. The inner jigs 52 are slidably mounted to the truss table 12. In the preferred embodiment, each of the inner jigs 52 are mounted to a truck assembly 56 including an upper jig truck 58 which is supplied with truck wheels 60. The upper truck 58 is connected, such as with truck spacers 62, to a lower jig truck 64 which is similarly supplied with wheels 60. The jig trucks 58 and 64 straddle the clamping slot 66 and the wheels 60 allow the trucks 58 and 64 to roll along the upper and lower surfaces of the table plates 18, respectively. The truck spacers 62 extend through clamping slot 66 which is formed in the table plate 18 in a transverse direction across the truss table 12 as best seen in FIGS. 3 and 4. Other methods of slidable mountings, such as friction mountings, may be used without departing from the spirit of the invention. The jig trucks 58 and 64 are attached to a jig actuator, such as the air cylinder 68 shown. Other actuators may be employed, and may be mounted above or below the table surface, although the actuator design illustrated is preferred for reasons hereinafter explained. The air cylinders 68 are mounted under the surface of the table plates 18 by jig actuator brackets. The extendable air cylinder jig rods 72 are connected to the truck assemblies 58 and 64.

Turning to the clamping assembly in zone A, when the air cylinder 68 is in a retracted position, as in FIGS. 4 and 6, the inner jig 52 is positioned near the center of the truss table 12 in a home position 74 as shown. As the air cylinder 68 is actuated, the rod 72 extends outwardly, moving the truck assembly 56, which in turn moves the inner jig 52, across the truss table 12 along the clamping slot 66 toward the outer jig 54 to an extended or clamped position 76, as seen in FIG. 5. The air cylinder 68 will extend to its full length or until the inner jig 52 encounters and clamps truss into place in zone A. Similarly, a truss 22 in zone C may be clamped in place by actuation of the air cylinder 68, of the clamping assembly in zone C which will move the truck assembly 56 and inner jig 52 toward outer jig 54. The trusses 20 and 22 are unclamped after the gantry press 14 has embedded the connector plates 46 into the truss by retraction of the air cylinder to their retracted position, seen in FIG. 4.

Referring back to FIG. 4, each inner jig 52 is preferably activated independently with a corresponding air cylinder 68. The clamping assemblies 50 act in unison to hold the trusses 20 and 22 in place. Where inner jigs 52 do not encounter a truss, they are extended as far as the air cylinder 68 will allow. One of the advantages in having a plurality of clamping assemblies 50 each with a separate inner jig 52 acting on a single truss 20 as explained herein. Floor trusses, such as those seen in FIGS. 3–5, have parallel top and bottom chords 42. In low-slope roofing applications, however, the members 42 are not parallel. Sloped chord trusses can be assembled.in the present truss assembly apparatus 10 because the plurality of clamping assemblies 50 will contact the sloping member 43 at more than one point on the truss, or along its entire length, as shown. A single longitudinal inner jig 52 which ran the length of the table, such as is common, would only contact the sloped member 43 at a single location. The inner jigs 52 of the invention may be pivotally attached to the jig trucks 58, if desired, to allow for contact between the jigs and truss members with greater slopes.

Once the gantry press 14 has embedded the connector plates 46 into the trusses in zones A and C, the truss in zone C must be lifted out and removed from the table. The truss in zone A must be lifted out, turned over and placed in zone C for completion of the fabrication.

Figure 8:
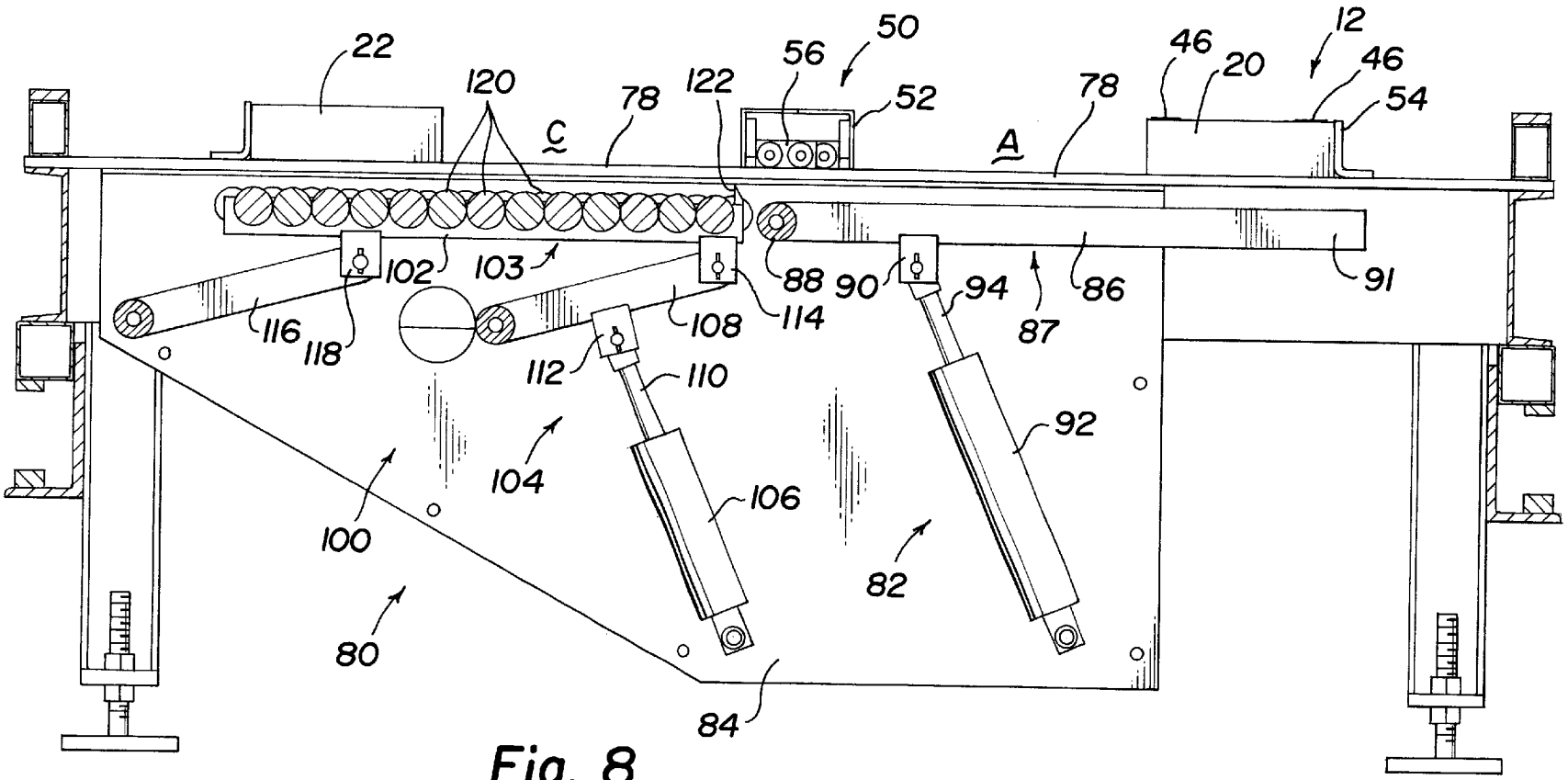
FIG. 8 is an elevational sectional view of a truss table of the invention with a truss movement assembly taken along line 8—8 of FIG. 3.
Figure 9:
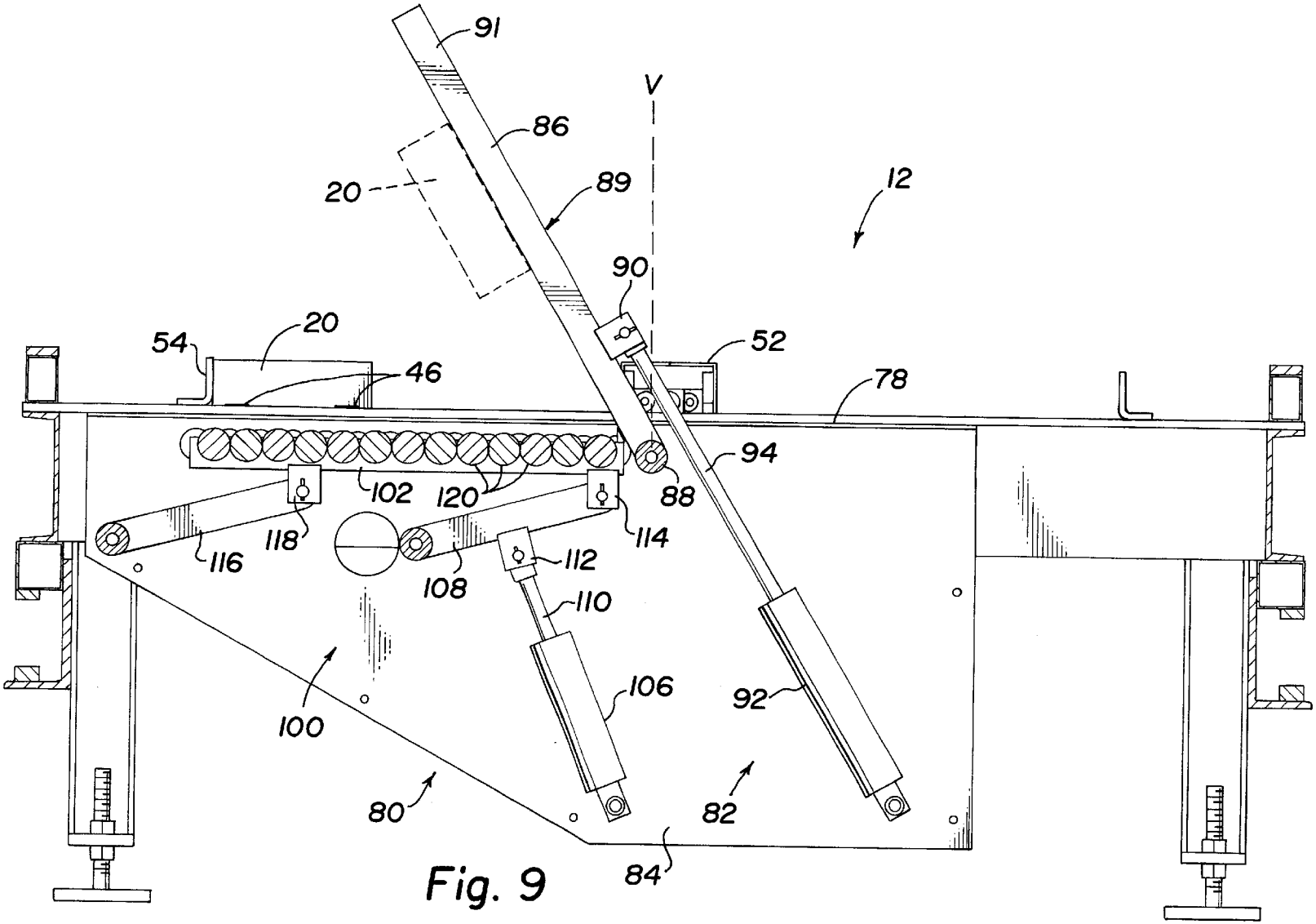
FIG. 9 is an elevational sectional view of a truss table of the invention with a truss movement assembly with the flip-over assembly actuated.
Figure 10:
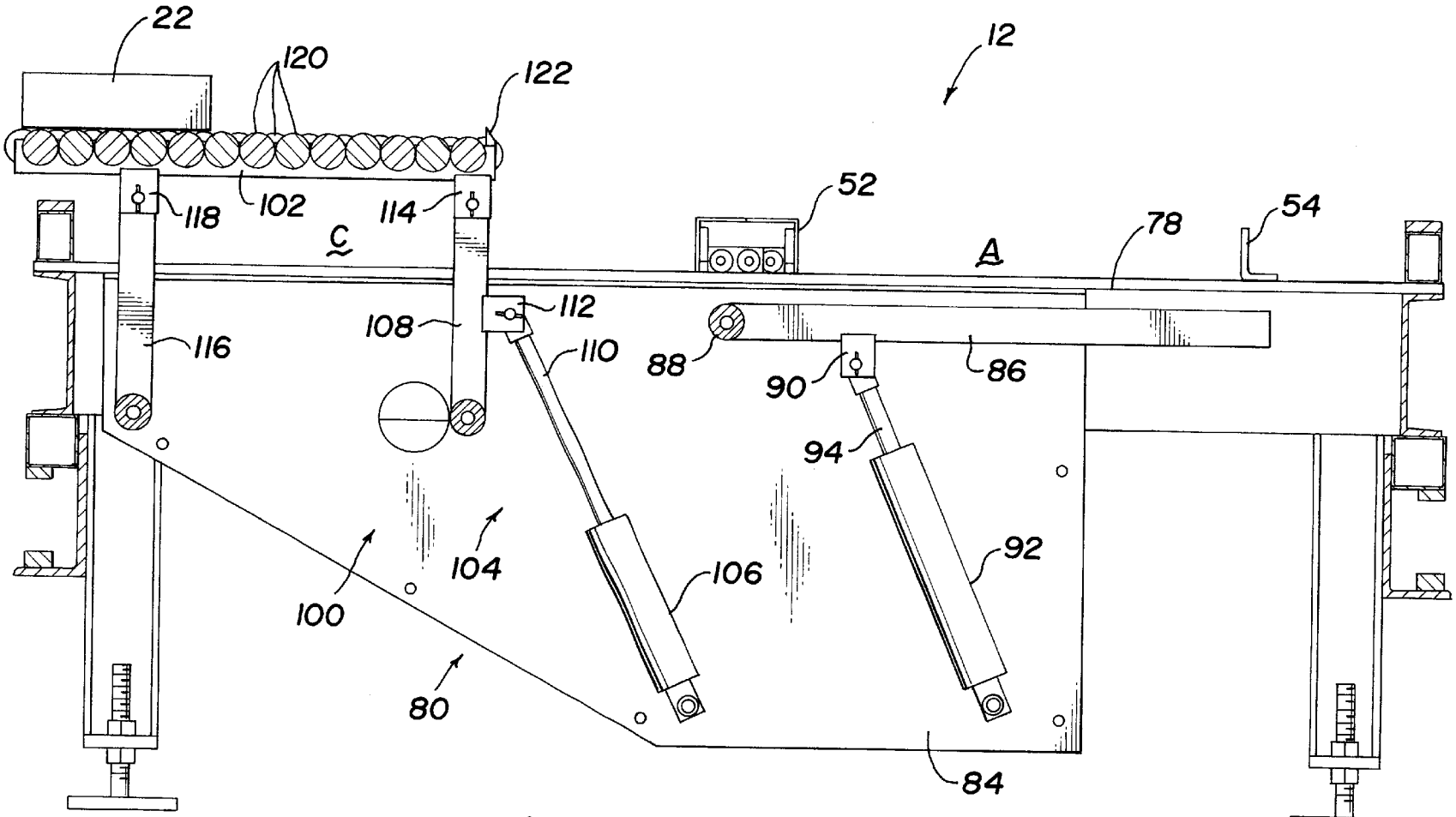
FIG. 10 is an elevational sectional view of a truss table of the invention with a truss movement assembly with the lift-out assembly actuated.

Movement of the trusses is accomplished with the truss movement assembly 80, seen in FIGS. 8–10, which comprises a flip-over assembly 82 and a lift-out assembly 100.

The flip-over assembly 82 is located adjacent zone A and is attached to the lower surface of the truss table 12 by the truss movement assembly bracket 84. The flip-over assembly 82 comprises an elongate flip-over arm 86 which is connected at one end by a flip-over arm pivot mounting 88 to the movement assembly bracket 84 adjacent the lower surface of the table 12. A flip-over arm bracket 90 pivotally connects the flip-over arm 86 at a point removed from the flip-over pivot mounting 88 to one end of the flip-over actuator 92. In the preferred embodiment, the flip-over actuator is an air cylinder 92 having one end pivotally connected to the movement assembly bracket 84 and the rod end 94 connected to the flip-over arm bracket 90.

While the truss 20 is being assembled and pressed, the flip-over assembly 82 is in a home position 87, as seen in FIG. 10, wherein the flip-over arm 86 is positioned not to interfere with assembly of the truss 20. The flip-over arm 86 is pivoted to the extended position 89, seen in FIG. 9, by the extension of the rod 94 of the air cylinder 92. The flip-over arm passes through assembly slot 78 to contact the truss 20. The flip-over arm 86 and actuator are arranged such that the flip-over arm rotates through and preferably past the vertical plane V so that the truss 20 is rotated longitudinally before falling from the flip-over arm 86 into zone C. Preferably, at least the end 91 of arm 86 moves to a position over zone C, as shown in FIG. 9. The motion and extended position 89 of the flip-over arm 86 thus lifts the truss 20 from zone A, rotates and deposits it such that the connector plates applied to the truss face downwardly in zone C.

Prior to the actuation of the flip-over arm 86, the movable inner jigs 52 are brought to their home position at the center of the table. With the inner jigs so arranged, abutting one another, the area of zone B, evident when the braces are clamping the trusses as in FIG. 7, is reduced greatly, or preferably completely, as in FIG. 8. Many truss assembly mechanisms are unable to greatly reduce or eliminate the area of zone B because of the jig mechanisms disposed in the intermediate zone. The present invention eliminates the area of zone B by mounting the clamping assembly actuators below the table surface and moving the jigs via the small jig trucks actuated through the clamping slots. Because of this feature, the flip-over arm is designed to deposit the truss directly to zone C. In prior art inventions the truss is deposited at least partially into zone B requiring manual relocation of the truss into zone C for further assembly.

The lift-out assembly 100 is positioned adjacent zone C and is attached to the truss movement assembly bracket 84 which is mounted to the table 12 below the work surface 16 as shown. The lift-out assembly 100 comprises a lift-out arm 102 and a lift-out actuator assembly 104. The lift-out arm 102 is seen in its home position 103 in FIG. 8, wherein the lift-out arm 102 does not interfere with assembly of the truss 22. After completion of assembly of the truss 22 the lift-out actuator assembly 104 is activated to raise the lift-out arm 102 and move it laterally towards the outer rail 32 at the edge of the table 12 into the extended or finished position 105 seen in FIG. 10. The lift-out arm 102 acts on the truss 22 after passing from below the table surface 16 to above the table surface through assembly slot 78. The lift-out arm 102 in turn moves the truss 22 to a position out of zone C and toward the table edge for removal to a conveyor assembly or to storage. The lift-out arm 102 is designed to raise the truss 22 above the outer rail 32. Also, the lift-out arm 102 is preferably designed such that in the extended position the lift-out arm 102 extends slightly past the outer rails 32 of the table for ease of removal of the truss from the table.

The lift-out actuator assembly 100, in the preferred embodiment, comprises a lift-out actuator, such as the air cylinder 106, pivotally connected at one end to the movement assembly bracket 84 and pivotally attached at the other end to the lift-out power arm 108. In the preferred embodiment, the actuator is an air cylinder, but other actuating devices may be employed. The rod end 110 of the air cylinder 106 is pivotally attached to the lift-out power arm 108 through the cylinder bracket 112. The lift-out power arm 108 is pivotally mounted to the movement bracket 84 at one end and pivotally attached to the lift-out arm 102 at the other end through the power arm bracket 114. Similarly, the support arm 116 is pivotally connected to the movement assembly bracket 84 at one end and to the lift-out arm 102 at the other end through a support arm bracket 118. When the air cylinder 106 is actuated, the rod end 110 extends outwardly, pivoting the power arm 108 which in turn lifts and laterally moves the lift-out arm 102. The support arm 116 acts to raise and laterally move the lift-out arm in conjunction with the power arm to the extended position. Actuator assemblies other than the described system may be used without departing from the spirit of the invention.

Preferably, the lift-out arm 102 has a plurality of rollers 120 connected thereto to assist the user in moving the truss 22 off of the lift-out arm 102. The lift-out arm 102 also preferably has a stop block 122 attached to the lift-out arm 102 at its innermost end. The stop block 122 prevents the truss from rolling from the rollers 120 onto the truss table 12.

The truss assembly apparatus described herein is preferably for use in fabricating wooden trusses and joists, although non-wooden members may be used as well.

Figure 11:
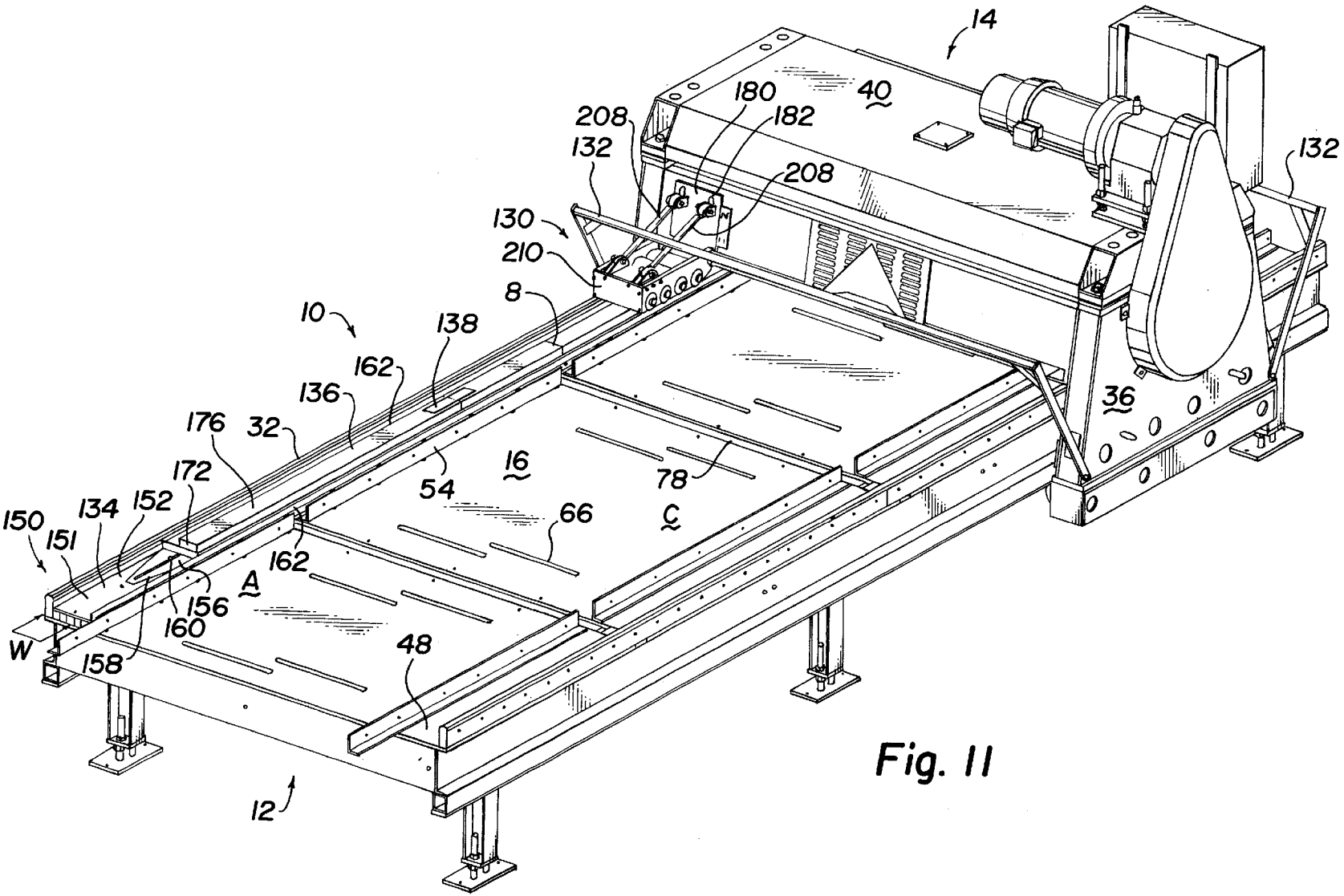
FIG. 11 is an isometric partial view of a truss assembly table with splicing subassembly of the present invention.
Figure 12:
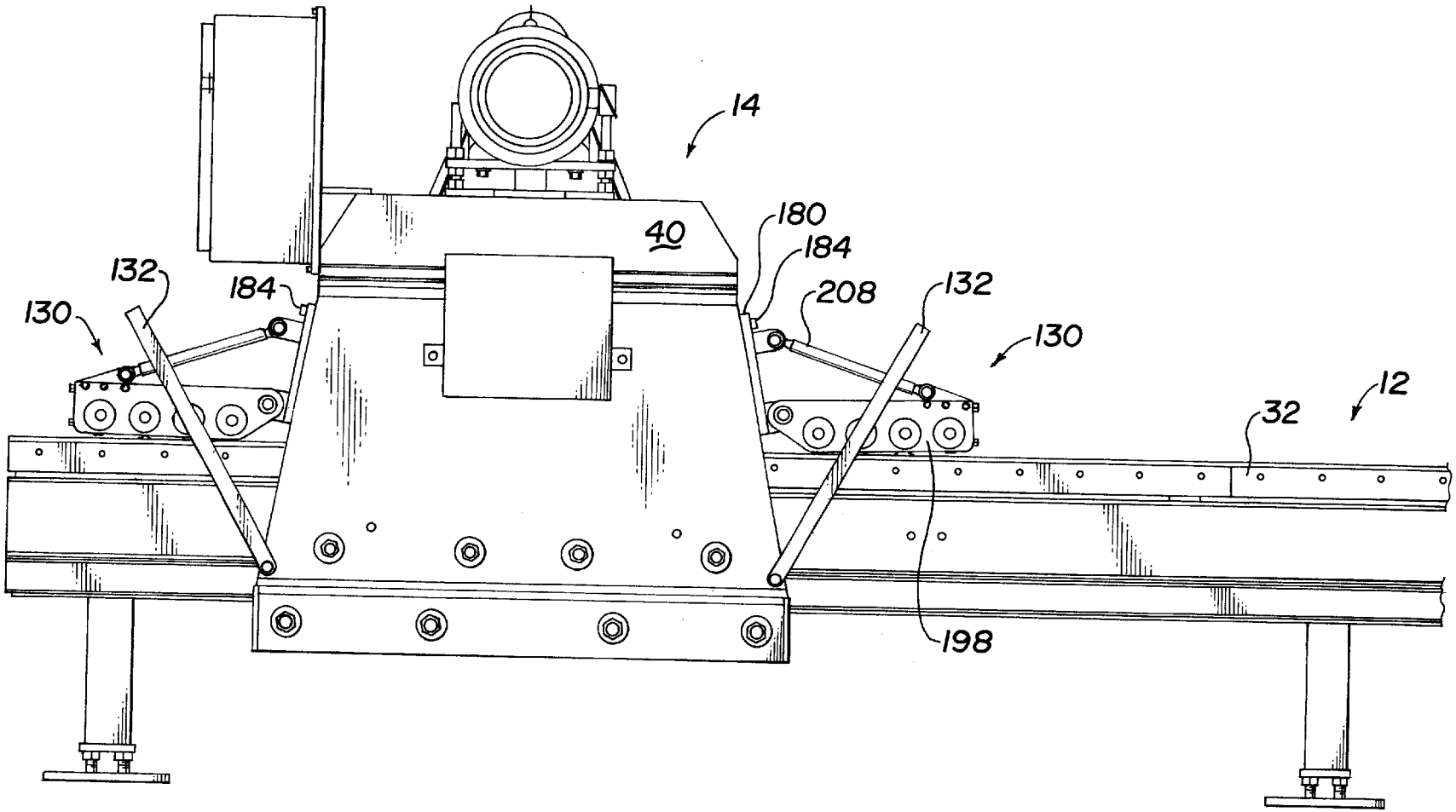
FIG. 12 is an elevational partial view of a truss assembly table with splicing subassembly of the present invention.
Figure 13:
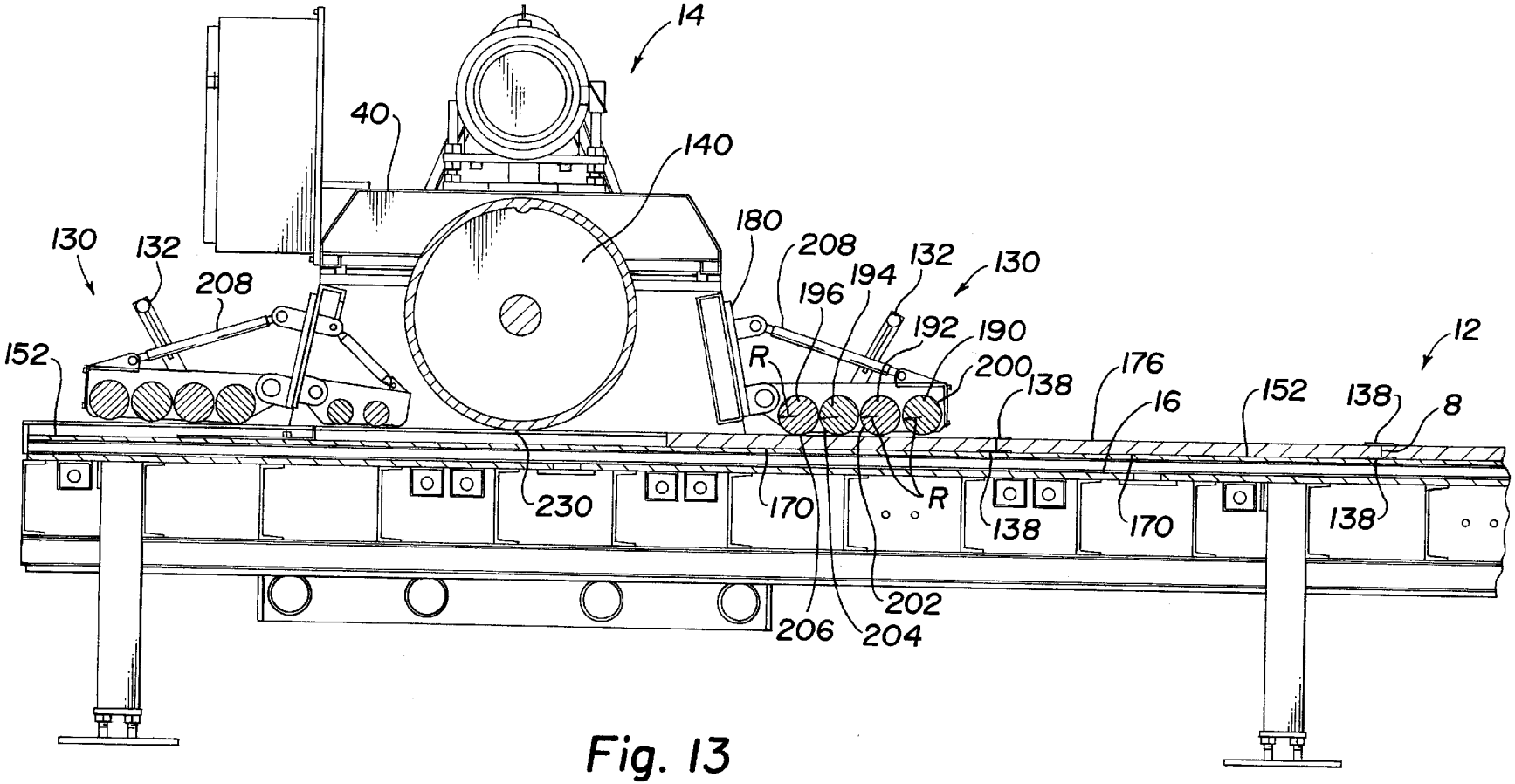
FIG. 13 is a sectional view of FIG. 12.

Splicing Apparatus:

A truss assembly apparatus 10 with splicing subassembly 130 is shown in FIGS. 11–17. FIG. 11 is an isometric view of a partial truss assembly apparatus 10 with splicing subassembly 130. FIG. 12 is an elevational view of a partial truss assembly apparatus 10 with splicing subassembly 130. FIG. 13 shows the same elevational view in cross-section. The clamping assemblies 50 and truss assemblies 20 and 22 are removed for clarity.

In FIGS. 11–16, the table gantry press 14 straddles the work surface 16 of the truss table 12 and is supported to run along the length of the table. A primary roller press 140, seen in FIG. 13, located in the gantry body 40 presses downwardly on the truss table 12 as the gantry press 14 passes along the table length. Safety stop bars 132 provide for an automatic power cut to the apparatus should they be tripped during operation.

Figure 2:
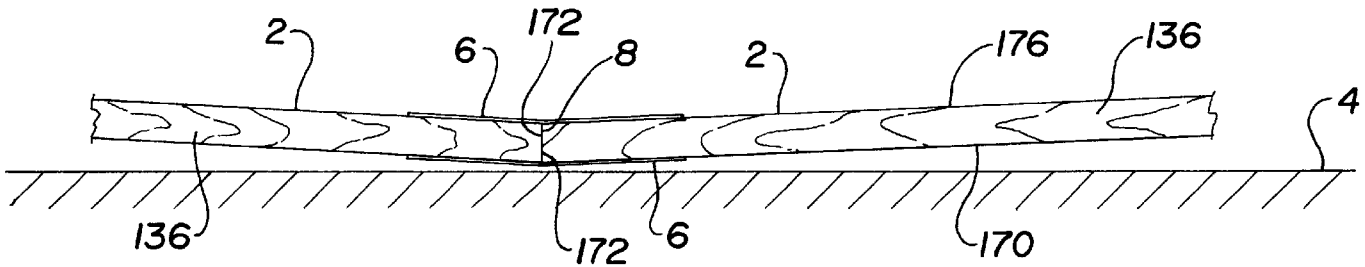
Fig. 2 (PRIOR ART)
FIG. 2 is an elevational schematic view of a typical prior art spliced chord member.

Truss assembly table 12 has a splice assembly area 134 along one longitudinal edge of the table, inside outer rail 32. When the truss assembly table 12 is in use without the splicing subassembly 130 attached to the gantry press 14, splice assembly area 134 serves as recessed area 48 for temporary storage of connector plates prior to placement on a truss assembly 20 as explained above. Splice assembly area 134 supports chord members 136 in end-to-end abutment on splice work surface 152. Each chord 136 is supported longitudinally along assembly area 134 along a chord bottom surface 170 (seen in FIG. 13). Each chord top surface 176 is seen in FIG. 11. Adjacent chord end surfaces 172 abut at end-joint 8. Chord members in FIGS. 1 and 2 have been similarly numbered for clarity. Multiple chord members may be placed longitudinally in the splice assembly area in end-to-end arrangement to create a final spliced chord of any desired length. Connector plates 138 are placed above and below end-joint 8. Connector plates 138 are pressed into the chord members 136 by roller presses as the splicing subassembly 130 and gantry press 14 pass along the table length as will be explained in further detail.

The splice assembly area 134 is preferably adjacent to truss assembly zone A. In this arrangement, during a single pass of the gantry press 14 and splicing subassembly 130, chord members 136 are spliced together in splice area 134 while connector plates are pressed into a truss assembly in zone A as explained above.

Figure 15:
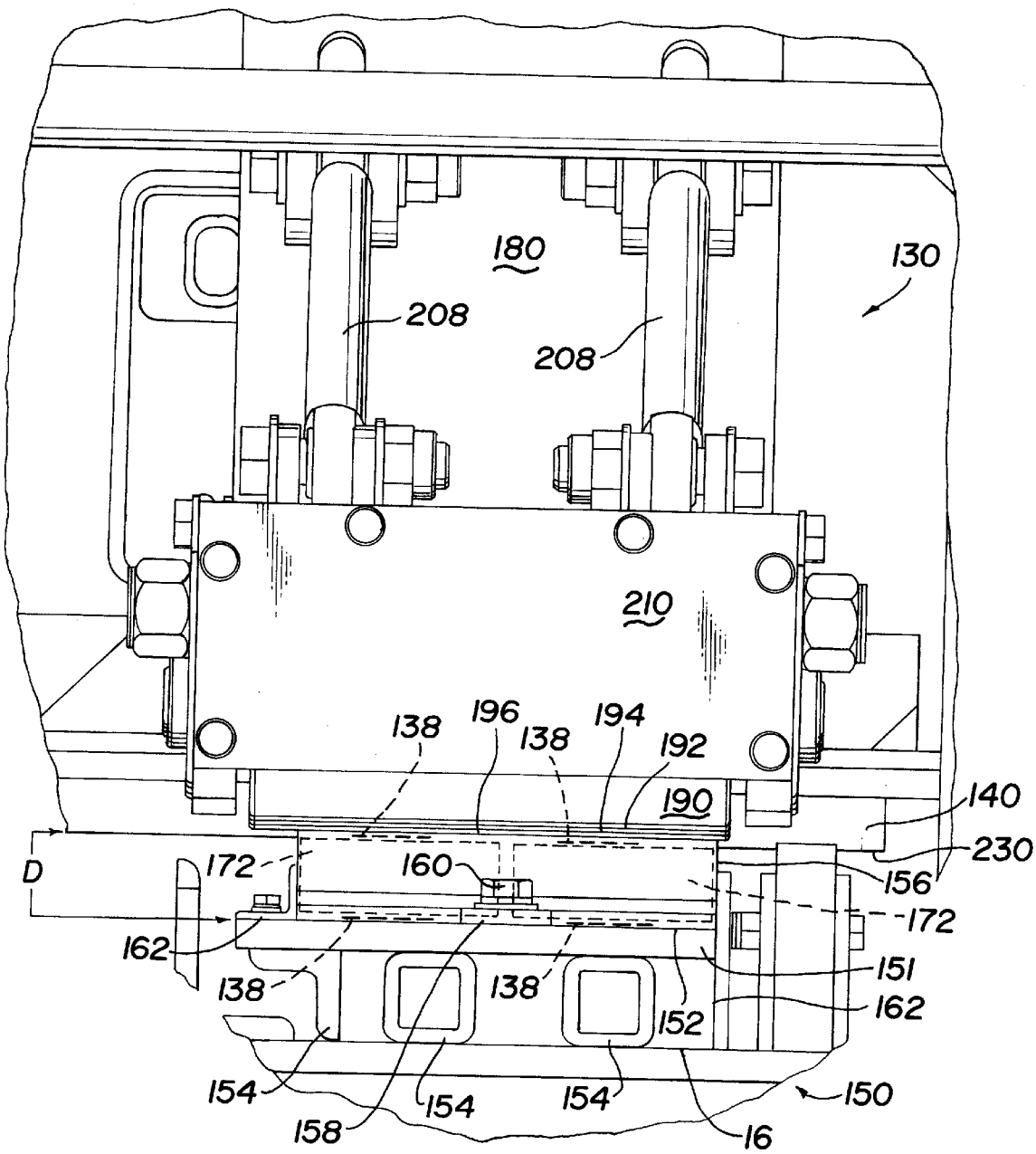
FIG. 15 is an end view detail of the splicing subassembly.
Figure 16:
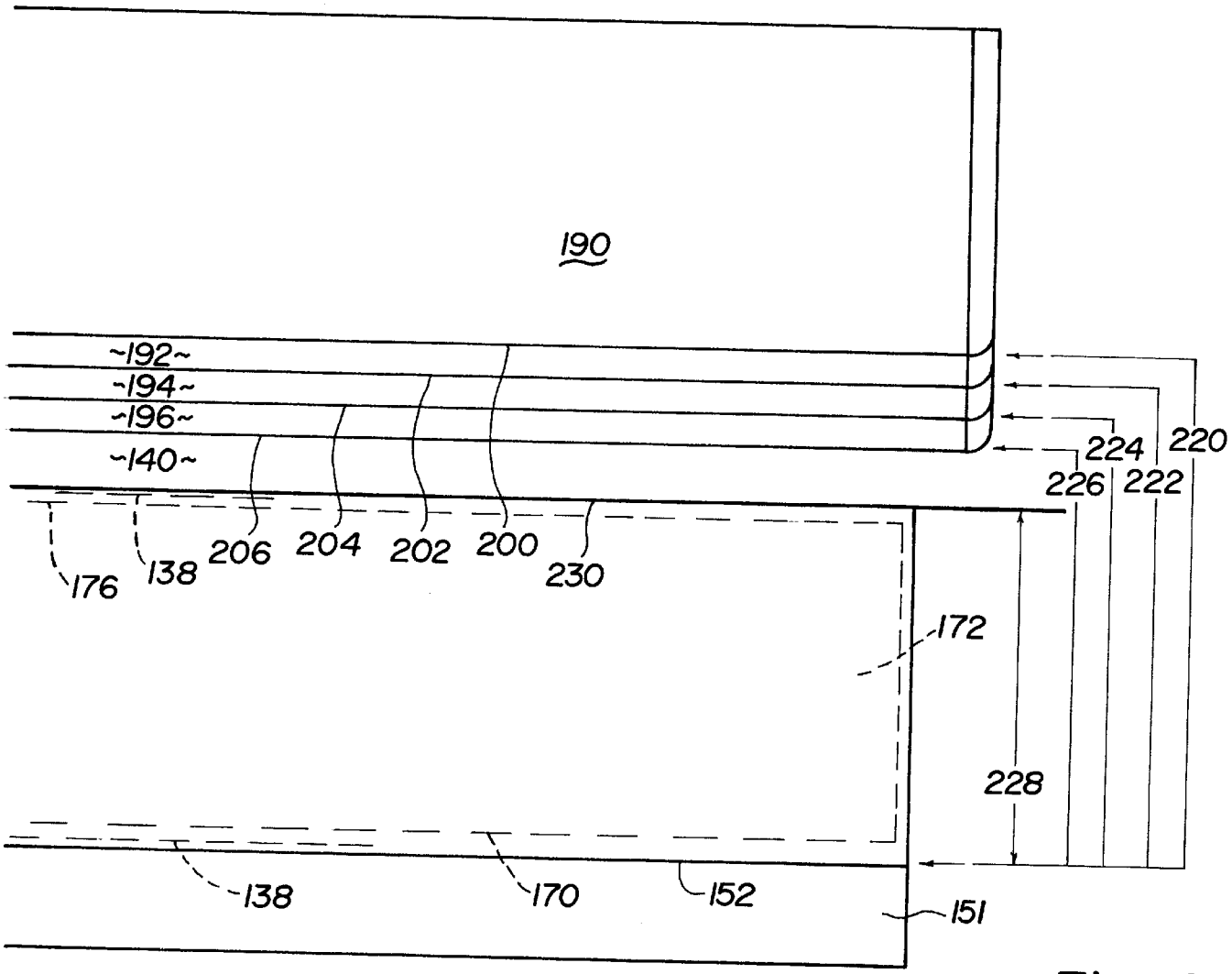
FIG. 16 is a schematic detail of the splice and gantry rollers in relation to the splice work surface.

Splice assembly area 134 is defined by the splice jig assembly 150, seen best in FIGS. 11 and 15. Splice plate 151 is supported above truss table surface 16 by jig spacers 154. Splice plate 151 supports the chord members 136 along splice work surface 152. Jig spacers 154 can be formed of metal tubing and angle iron, as shown in detail in FIG. 15, or any other suitable material. Chord members 136 are maintained in a stationary position during the pressing process by jig end-stops 156. The chord end surface 172 abuts jig end-stop 156 to prevent longitudinal movement of the chord members during the pressing process. Jig end-stops 156 can be adjusted longitudinally by sliding the stop along end-stop slot 158. The end-stop 156 is fixed in place by tightening end-stop nut-and-bolt assembly 160. A corresponding end-stop assembly can be affixed to the splice plate 151 at the opposite end of the splice assembly area (not shown). Typically only one end-stop is in use during a single pass of the gantry press and splicing subassembly. Since the gantry and splicer are arranged to press connector plates during passes in either direction, however, a jig end-stop is necessary on either end of the splice work area. The longitudinal edges of the chord members can be placed in abutment against the splice jig rail 162 to ensure the spliced chord members remain straight during the pressing process.

FIG. 15 is an end elevational view detail of the splice jig assembly 150 and splicing subassembly 130. The depth D of splice assembly area can be adjusted by selecting the size of spacers 154. Typically, depth D of the splice area is selected to accommodate a "two-by-four" chord member oriented with the "four-inch" bottom surface facing splice work surface 152. Those skilled in the art will recognize that "two-by-fours" do not actually measure two inches by four inches (5.08 cm by 10.16 cm). The spacing of the jig assembly parts will vary according to the actual dimensions of the chord members. The working depth of the truss assembly area, on the other hand, is typically selected to accommodate "two-by-fours" oriented with the "two-inch" surface face down in the truss assembly zone A. The difference in orientation of the splicing chord members and the truss assembly members necessitates the splice jig assembly. The working width W, seen in FIG. 11, of the splicing area 34 can be selected to accommodate two or more chord members side-by-side if desired, as shown in FIG. 15. In this manner, multiple spliced truss chords 42 can be spliced during a single pass of the gantry press 14 and splicer 130.

Figure 14:
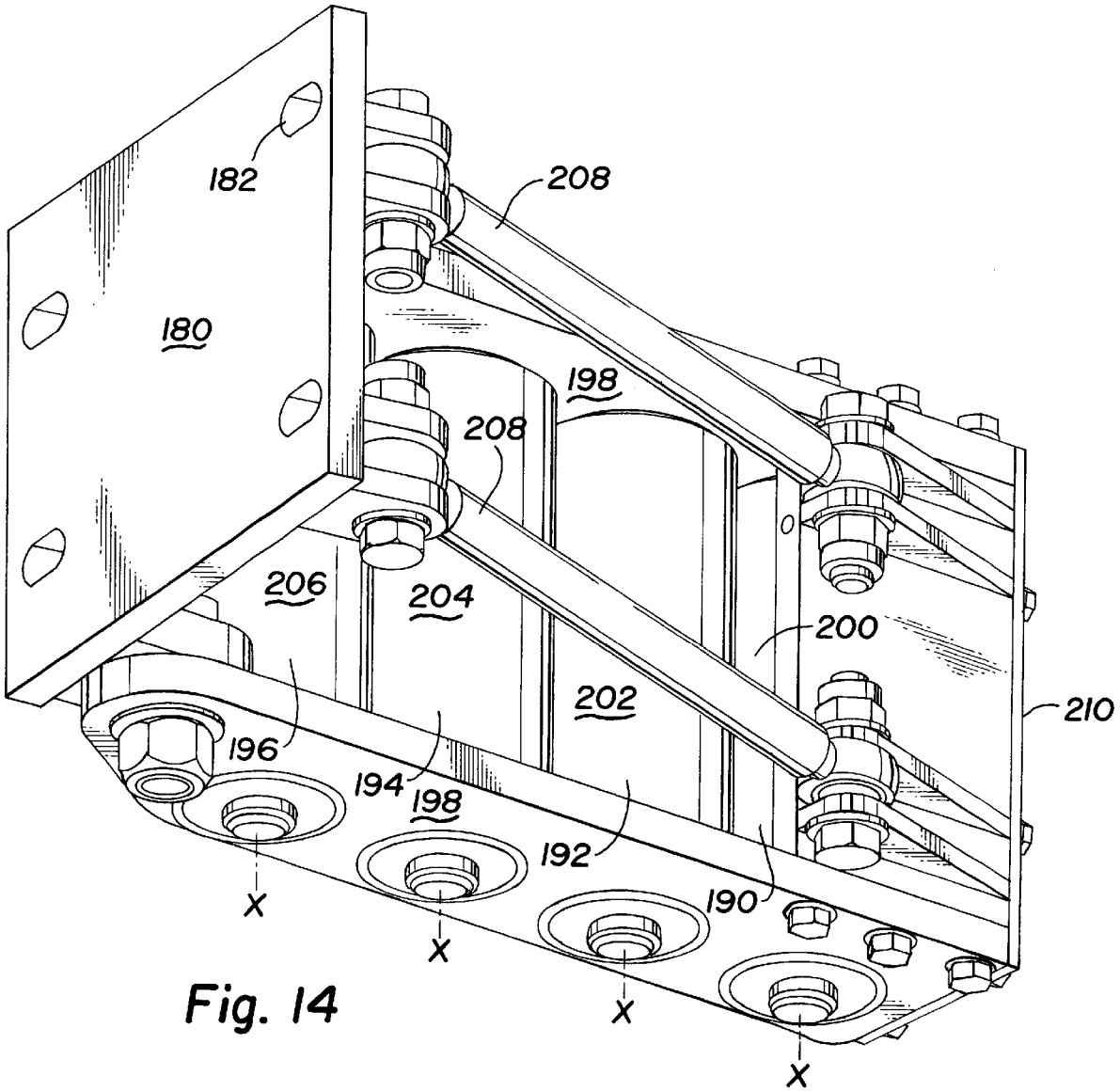
FIG. 14 is an isometric view detail of the splicing subassembly.

FIG. 14 is a detailed isometric view of the splicing subassembly 130. FIG. 15 is a detailed view of the subassembly. Splicing subassembly 130 is mounted to the gantry body 40 via mounting plate 180. The mounting plate 180 has multiple mounting slots 182 through which nut-and-bolt assemblies 184 (seen in FIG. 12), extending from the gantry body 40, are arranged. The slots 182 allow the splicing subassembly 130 to be adjusted vertically on gantry press body 40 by sliding the mounting plate 180 along slots 182. The plate 180 is fixed in place by tightening the nut-and-bolt assembly 184. An identical, but reverse oriented, splicing subassembly can be mounted on the opposite side of the gantry press body 40, as seen in FIG. 12. This allows the user to splice chord members as the gantry press 14 and splicers 130 move in either direction along the truss table 12.

Splicing subassembly splice rollers 190, 192, 194 and 196 are mounted on support arms 198. Splice rollers 190, 192, 194 and 196 have cylindrical roller peripheral surfaces 200, 202, 204 and 206, respectively, for contacting the connector plates 138, and each splice roller rotates about its respective roller axes X. Splicing subassembly adjustment arms 208 are pivotally mounted to mounting plate 180 at one end and pivotally mounted to end-plate 210 at the opposite end. Adjustment arms 208 can preferably be shortened or lengthened by turning reverse-threaded tubing attached to reverse-threaded bolts located at either end of the adjustment arms. Adjustment of the length of arms 208 correspondingly adjust the positions of splice rollers 190, 192, 194 and 196. Other methods of adjustment will be readily recognized by those skilled in the mechanical arts.

The splice subassembly supports the splice rollers 190, 192, 194 and 196 at successively smaller distances above the splice work surface 152. As shown best in FIG. 16, each splice roller peripheral surface 200, 202, 204 and 206, at the point closest to the work surface 152, is spaced a clearance distance 220, 222, 224 and 226, respectively, above the work surface 152. The clearance distances 220, 222, 224 and 226 can be adjusted by adjusting the mounting plate 180 along slots 182 and by adjusting the length of the adjustment arms 208. The clearances are selected such that each roller incrementally presses connector plates 138 into the chords 136. Preferably, both the top and bottom connector plates 138 are pressed into the chord members by the splice rollers and primary gantry roller 140. It is not necessary to place connector plates both above and below end-joints 8, but it is preferred.

Preferably the splice roller clearance distances are spaced 1/16th of an inch (0.159 cm) apart. That is, the second splice roller 192 to pass over the connector plates and chord members has a clearance distance 222 which is 1/16th of an inch (0.159 cm) closer to the splice work surface 152 than the clearance distance 220 of the first splice roller 190 to pass over the connector plate. Similarly, each successive roller to pass over the chord members and connector plates is preferably 1/16th of an inch (0.159 cm) closer to the work surface 152. The primary roller 140 of the gantry press also acts upon the connector plates and has a peripheral surface 230 and a corresponding clearance distance 228. The primary roller 140 acts a last splice roller and presses the connector plates a last incremental distance into the chords. Preferably the clearance distance 228 of the primary roller 140 is 1/8th of an inch closer to the work surface 152 than the clearance distance 226 of the splice roller 196 which is closest to the work surface 152. The clearance distances may vary from those listed and not depart from the spirit of the invention. The clearance distances above the work surface will vary depending upon the application and the dimensions of the chord members and connector plates selected.

The successively closer splice rollers and primary roller each incrementally advance the connector plates into the wooden chord members. The gradual pressing of the connector plates into the chord members by the passing of the plurality of rollers eliminates the bow or bend often present in spliced chords of the prior art.

Each splice roller 190, 192, 194 and 196 has a radius R and rotates about an axis X. Preferably the axes X are parallel as shown and the radii R are equal for the rollers. The rollers may be of differing radii. For example, each of the splice rollers and the primary gantry roller 140 acts upon the connector plates 138 to press the plates into the chord members 136 even though the gantry press roller 140 has a much greater radius than the splice rollers.

An alternate arrangement of the splicing subassembly is shown in FIG. 13. The splicing subassembly can be supported either entirely outside of gantry body 40, as shown on the right side of the Figure, entirely inside of gantry body 40 (not shown) or both inside and outside of gantry body 40, as shown on the left side of the Figure. Further, the splicer can have a greater number of rollers (such as the six shown on the left side of FIG. 13) or lesser number of rollers than illustrated.

Method of Use:

In utilizing the splicing subassembly 130, precut chord members 136 are placed in end-to-end abutment in splice assembly area 134. One end surface 172 of chord 136 preferably abuts end stop 156 to prevent longitudinal movement of the chords 136 during pressing operations. The longitudinal edges of the chords preferably abut outer rail 32. At least one connector plate 138 is placed over each end-joint 8. Preferably connector plates are likewise place below each end-joint 8. The splice rollers 190, 192, 194 and 196, can be adjusted using the mounting slots 182 and adjustment arms 208 to position the peripheral surfaces 200, 202, 204 and 206 above the work surface 152 at respective clearance distances 220, 222, 224 and 226. The clearance distances are selected such that each roller successively presses the connector plates an incremental distance into the chord members. Similarly, the primary press roller 140 can be adjusted to incrementally press the connector plates into the chord members. Preferably, each roller presses the connector plates into the chord members no more than 1/8th of an inch (0.318 cm). The gantry press 14 and attached splicing subassembly 130 are moved relative to the work surface 152 over the chord members 136 and connector plates 138. As the gantry press and splicing subassembly pass over the chords, the plates are pressed into the chord members incrementally. After the gantry has passed the work area 134, the now spliced chord members can be moved to the truss assembly area to be utilized in a truss assembly.

In utilizing the truss assembly apparatus 10, precut wooden truss members 42 and 44 are arranged in zone A of the truss table 12 on the working surface 16. Simultaneously, a semi-finished truss 22 is positioned in zone C. The clamping assemblies 50 are actuated, moving the inner jigs 52 outward toward the outer jigs 54 and clamping the trusses 20 and 22 between the jigs. End stops and other devices known in the art may be added to assist in the proper arrangement of the truss members. Connector plates 46 are placed over the joints between the truss members in both zones A and C and are usually manually tapped into the wood so that they will hold their positions during pressing. The gantry press 14 moves along the length of the table embedding the connector plates 46 into the wood. The clamping assemblies 50 are returned to their original home positions 74 such that the jigs are no longer clamping the trusses. In the home positions, the clamping assemblies preferably have little or no space between them in zone B, at the center of the table. This is, in part, accomplished by positioning the jig actuators 68 below the table surface 16. The lift-out assemblies 100 are then actuated to move the lift-out arms 102 into extended positions 105, that is, to move the lift-out arms upwardly through the assembly slots 78 from below the table surface 16 and engage the truss 22 thereby raising it out of zone C and moving it toward the outer rails 32 of the table. Preferably the lift-out arm 102 include rollers 120 and move in the extended position 105 to extend over the outer rails 32 for ease of removal of the truss 22 from the truss table 12. The lift-out arm 102 may also include stop blocks 122 to prevent the truss 22 from rolling off the lift-out arms 102 the wrong direction. The lift-out out arms 102 are lowered back into position under the table surface 16. The flip-over assemblies 82 are then activated. The flip-over arms 86 are rotated from a home position 74 under the table surface to an extended position 76, engaging the truss 20 and lifting it from zone A while simultaneously rotating it along its longitudinal axis L. The flip-over arms 86 deposit the truss 20 in zone C with the connector plates 46 facing downward. The flip-over arms 86 are then returned to their home positions 74. The order of the steps may vary without departing from the spirit of the invention. The process may be repeated as desired.

The truss assembly and splicing methods can be practiced simultaneously on the apparatus of the present invention. That is, on a single pass of the gantry press and splicing subassembly connector plates can be pressed into chord members in the splicing area and into a truss assemblies in the truss assembly zones A and C. Alternately, it will be readily apparent that the splicing subassembly can be operated independently of the truss assembly table and gantry press 14. A separate splicing apparatus would not include the truss assembly area of the preferred embodiment. It is preferred that the truss assembly method and splicing method be practiced as explained, however, since this allows for splicing and truss assembly to occur on the same machine, thereby saving the time, space and labor involved in utilizing a splicing machine and then transferring the spliced chords to a separate truss assembly table.

We claim:

1. A splicing apparatus for connecting chord members end-to-end, the apparatus comprising:

a table having a table surface for supporting abutting chord members in end-to-end abutment;

a gantry press mounted adjacent to the table surface and configured to move on gantry tracks relative to the table surface, the gantry press having at least two press rollers, each press roller having a peripheral surface positioned a successively closer clearance distance to the table surface.

2. A splicing apparatus as in claim 1, further comprising at least two end to end abutting chord members supported on the table surface, the chord members forming end-joints at each abutment; and further comprising at least one connector plate positioned above each end-joint whereby each of the press rollers presses the connector plates at least partially into the chord members as the gantry press moves relative to the table surface.

3. A splicing apparatus as in claim 2 further comprising at least one connector plate positioned below each end-joint.

4. A splicing apparatus as in claim 1 wherein the gantry press comprises five press rollers.

5. A splicing apparatus as in claim 4 wherein the peripheral surfaces of the at least two press rollers are positioned successively closer to the table surface in increments of no more than ⅛th of an inch.

6. A splicing apparatus as in claim 1 wherein the press rollers are adjustable whereby the clearance distances of the peripheral surfaces of the press rollers above the table surface can be adjusted.

7. A splicing apparatus as in claim 1 wherein the at least two press rollers are of similar size.

8. A splicing apparatus as in claim 1 wherein the table further comprises a surface for supporting truss assembly members.

9. A splicing apparatus as in claim 8 wherein the gantry press further comprises a splicing subassembly, at least one of the press rollers being supported above the table surface by the splicing subassembly.

10. A splicing apparatus as in claim 1 wherein the chord members are wooden.

11. A splicing apparatus for connecting chord members, the apparatus comprising:

a table having a table surface for supporting at least two chord members in end-to-end abutment, the chord members forming end-joints at each end-to-end abutment;

at least one connector plate positioned above each end-joint;

a gantry press mounted to move relative to the table on gantry wheels;

a plurality of press rollers mounted on the gantry press and above the table surface and configured to move relative to the table surface, each press roller having a peripheral surface, each press roller peripheral surface positioned a clearance distance above the table surface, the peripheral surfaces having successively smaller clearance distances such that the press wheels successively press each connector plate further into the chord members as the plurality of press rollers moves relative to the table surface.

12. A splicing apparatus as in 11 further comprising at least one connector plate positioned below each end-joint.

13. A splicing apparatus as in 11 wherein the plurality of press rollers comprises five press rollers.

14. A splicing apparatus as in 11 wherein the peripheral surfaces of the at least two press rollers are positioned successively closer to the table surface in increments of no greater than ⅛th of an inch.

15. A splicing apparatus as in 11 wherein the clearance distances of the peripheral surfaces of the plurality of press rollers are adjustable.

16. A splicing apparatus as in 11 wherein at least two of the plurality of press rollers are of similar size.

17. A splicing apparatus as in 11 wherein the table further comprises a surface for assembling members of a truss.

18. A splicing apparatus for connecting chord members end-to-end, the apparatus comprising:

a table having a table surface for supporting abutting chord members;

a gantry press, having gantry wheels, capable of moving relative to the table;

a first and last press roller supported by the gantry press above the table surface and configured for movement relative to the table surface, the first press roller having a first roller peripheral surface positioned a first clearance distance above the table surface and the last roller having a last roller peripheral surface positioned a last clearance distance above the table surface, the first clearance distance greater than the last clearance distance.

19. A splicing apparatus as in 18, further comprising at least two abutting chord members supported on the table surface, the chord members forming end-joints at each abutment; and further comprising at least one connector plate positioned above each end-joint whereby the first and last press rollers each press the at least one connector plate at least partially into the chord members as the first and last press roller move relative to the table surface.

20. A splicing apparatus as in 19 further comprising at least one connector plate positioned below each end-joint.

21. A splicing apparatus as in 18 additionally comprising a second press roller supported above the table surface between the first and last press roller, the second press roller configured for movement relative to the table surface, the second press roller having a second peripheral surface positioned a second clearance distance above the table surface, the second clearance distance greater than the last clearance distance and less than the first clearance distance.

22. A splicing apparatus as in 21 wherein the difference between the peripheral distances of any two adjacent rollers is no greater than ⅛th of an inch.

23. A splicing apparatus as in 18 wherein the clearance distances of the peripheral surfaces of the press rollers can be adjusted.

24. A splicing apparatus as in 22 wherein the clearance distances of the peripheral surfaces of the first and second press rollers are adjustable.

25. A splicing apparatus as in 21 wherein the first and second press rollers are of the same size.

26. A method of splicing chord members end-to-end comprising the steps of:

placing multiple wooden chord members in end-to-end abutment on a table surface, providing a gantry press movable along gantry tracks, the cord members having end-joints at each end-to-end abutment;

placing at least one connector plate over each end-joint;

pressing the at least one connector plate into the chord members with the gantry press supported above the table surface and configured for movement relative to the table surface, the gantry press having a plurality of press rollers, each press roller having a peripheral surface positioned successively closer to the table surface, each press roller incrementally pressing the at least one connector plate into the chord members.

27. A method as in claim 26, further comprising the step of placing at least one connector plate under each end-joint between chord members.

28. A method as in claim 26, the plurality of press rollers each having a peripheral surface, each peripheral surface having a clearance distance above the table surface; and further comprising the step of adjusting the clearance distances of the peripheral surfaces of the press rollers.

29. A method as in claim 26, the plurality of press rollers comprising five press rollers.

30. A method as in claim 29 wherein four of the press rollers are of the same size.

31. A method of splicing chord members comprising the steps of:

placing two wooden chord members in end-to-end abutment on a table surface thereby forming an end-joint between the chord members;

placing a connector plate over the end-joint;

pressing the connector plate partially into the chord members with a first press roller; and pressing the connector plate partially into the chord members with a last press roller.

32. A method as in claim 31 further comprising the step of pressing the connector plate partially into the chord members with a second press wheel.

33. A method as in claim 31, the first and last press roller supported above the table surface a first and last clearance distance, respectively;

further comprising the step of adjusting the first and last clearance distances.

34. A method as in claim 31 further comprising the step of placing a connector plate below the end-joint.

35. A truss assembly and chord splicing apparatus comprising:

a table having a truss assembly surface for supporting a truss assembly;

the table having a splicing surface for supporting end-to-end abutting chord members;

a gantry press assembly mounted adjacent to the table and configured to move relative to the table on gantry tracks, the gantry press assembly having a primary press roller configured to move over the truss assembly surface, the gantry press assembly having at least two splicing press rollers configured to move over the splicing surface, the at least two splicing press rollers each having a peripheral surface positioned successively closer clearance distances above the splicing surface.

36. An apparatus as in claim 35 further comprising:

a truss assembly having a plurality of abutting truss members positioned on the truss assembly surface, the truss members forming truss joints at each abutment;

at least one connector plate positioned above each truss joint;

at least two abutting chord members supported on the splicing surface, the chord members forming end-joints at each abutment;

at least one connector plate positioned above each end-joint.

37. An apparatus as in claim 36 further comprising at least one connector plate positioned below each end-joint.

38. An apparatus as in claim 35 wherein the primary press roller is further configured to move over the splicing surface.

39. An apparatus as in claim 35 wherein each clearance distance is adjustable.

40. An apparatus as in claim 35 wherein the truss assembly surface and the splicing surface are different heights above a floor surface.

41. A truss assembly and chord splicing apparatus comprising:

a truss assembly table having a truss assembly surface and a splicing surface;

a gantry press having a primary press roller and a splicing subassembly, the subassembly comprising at least two splicing press rollers, the splicing press rollers each having a peripheral surface positioned a successively closer clearance distance above the splicing surface, the gantry press having gantry wheels designed to move along gantry tracks mounted adjacent the table.

42. An apparatus as in claim 41 further comprising:

a plurality of truss assembly members in abutment supported on the truss assembly surface;

a plurality of chord members supported in end-to-end abutment on the splicing surface;

the truss assembly members and chord members forming joints at each abutment; and at least one connector plate positioned above each joint.

43. A method of forming a truss assembly and splicing a plurality of chord members, the method comprising the steps of:

placing a plurality of truss assembly members in abutment on a truss assembly surface;

placing a plurality of chord members in end-to-end abutment on a splicing surface, the truss assembly members and the chord members forming joints at each abutment;

placing at least one connector plate above each abutment; and pressing the connector plates into the members by moving a gantry press over the truss assembly and splicing surfaces.

44. A method as in claim 43 wherein the gantry press comprises a primary press roller configured to move over the truss assembly surface and a plurality of splicing press rollers configured to move over the splicing surfaces.

45. A method as in claim 44 wherein the primary press roller is configured to move over the splicing surface.

46. A method as in claim 44 wherein the plurality of splicing press rollers each have a peripheral surface positioned a successively closer clearance distance above the splicing surface.

47. An assembly apparatus comprising:

a table having a table surface with a splicing surface for supporting splice chord members in end-to-end abutment;

the table surface having a truss assembly surface for supporting truss members;

a gantry press positioned to move relative to the table surface, the gantry press operable to move on gantry tracks;

a main roller, supported above the table by the gantry press, the main roller configured for pressing connector plates into truss members;

a splicing sub-assembly having at least one splice roller, the splicing sub-assembly supported above the splicing surface by the gantry press, the at least one splice roller configured for pressing a connector plate into splice chord members.

48. An apparatus as in claim 47 wherein the at least one splice roller extends only across the splicing surface.

49. An apparatus as in claim 47 wherein the main roller extends across both the truss assembly surface and the splicing surface.

50. An apparatus as in claim 49, the main roller configured for at least partially pressing a connector plate into splice chord members.

51. An apparatus as in claim 50, the main roller having a peripheral surface positioned a main roller distance above the splicing surface, the at least one splice roller having a peripheral surface positioned a splice roller distance above the splicing surface, the splice roller and main roller operable to press a connector plate successively farther into splice chord members.

52. An apparatus as in claim 47, the splicing sub-assembly having multiple splice rollers, each of the splice rollers having a peripheral surface positioned at successively closer splice roller distances above the splicing surface such that each splice roller is capable of pressing a connector plate successively farther into splice chord members as the gantry press moves relative to the table surface.

53. An apparatus as in claim 50, the splicing sub-assembly having multiple splice rollers, each of the splice rollers having a peripheral surface positioned at successively closer splice roller distances above the splicing surface such that each splice roller is capable of pressing a connector plate successively farther into splice chord members as the gantry press moves relative to the table surface.

54. An apparatus as in claim 52 wherein each of the splice rollers is designed to press a connector plate into the splice chord members no more than $1/8^{th}$ of an inch per roller.

55. An apparatus as in claim 52 wherein each of the splice rollers is designed to press a connector plate into the splice chord members no more than $1/16^{th}$ of an inch per roller.

56. An apparatus as in claim 47 the splicing sub-assembly having four splice rollers.

57. An apparatus as in claim 47, the table having a second splicing sub-assembly mounted to the gantry press opposite the first splicing sub-assembly.

58. An apparatus as in claim 47 further comprising at least two end-to-end abutting splice chord members supported on the splicing surface, the splice chord members forming end-joints at each abutment; and further comprising at least one connector plate positioned above each end-joint whereby each of the rollers presses the connector plates at least partially into the chord members as the gantry press moves relative to the table surface.

59. An apparatus as in claim 58 further comprising at least one connector plate positioned below each end-joint.

60. An apparatus as in claim 47 wherein the at least one splice roller is adjustable.

61. An apparatus as in claim 52 wherein the splice roller distances above the splicing surface are at different heights above a floor surface.

62. An apparatus as in claim 47 wherein the truss assembly surface and the splicing surface are at different heights above a floor surface.

* * * * *